US007083387B2

(12) United States Patent
Chen et al.

(10) Patent No.: US 7,083,387 B2
(45) Date of Patent: Aug. 1, 2006

(54) AXIAL FLOW FAN

(75) Inventors: Te-Fu Chen, Taoyuan (TW); Tsung-Yu Lei, Taoyuan (TW); Kuo-Cheng Lin, Taoyuan (TW); Wen-Shi Huang, Taoyuan (TW)

(73) Assignee: Delta Electronics Inc., Taoyuan Hsien (TW)

( * ) Notice: Subject to any disclaimer, the term of this patent is extended or adjusted under 35 U.S.C. 154(b) by 84 days.

(21) Appl. No.: 10/857,899

(22) Filed: Jun. 2, 2004

(65) Prior Publication Data

US 2005/0180849 A1 Aug. 18, 2005

(30) Foreign Application Priority Data

Feb. 18, 2004 (TW) ..... 93103860 A

(51) Int. Cl.
*F01D 5/22* (2006.01)

(52) U.S. Cl. ..... 416/195; 416/189

(58) Field of Classification Search ..... 416/189, 416/194, 195, 196 A; 415/220, 222, 208.5, 415/186

See application file for complete search history.

(56) References Cited

U.S. PATENT DOCUMENTS

| | | | | |
|---|---|---|---|---|
| 3,201,857 | A * | 8/1965 | Klonoski | 29/889.3 |
| 3,279,684 | A * | 10/1966 | Waters | 416/204 R |
| 3,321,931 | A * | 5/1967 | Lehmkuhl | 62/281 |
| 3,531,221 | A * | 9/1970 | Engelbert et al. | 417/354 |
| 4,287,137 | A | 9/1981 | Sonoyama et al. | |
| 4,364,712 | A * | 12/1982 | Charles | 416/183 |
| 4,971,520 | A * | 11/1990 | Van Houten | 416/169 A |
| 5,437,541 | A * | 8/1995 | Vainrub | 416/223 R |
| 5,927,944 | A | 7/1999 | Belady | |
| 6,142,733 | A * | 11/2000 | Alizadeh et al. | 415/208.2 |
| 6,481,963 | B1 * | 11/2002 | Lin et al. | 415/220 |
| 6,517,315 | B1 * | 2/2003 | Belady | 415/221 |
| 6,524,067 | B1 * | 2/2003 | Chen et al. | 415/208.5 |

* cited by examiner

*Primary Examiner*—Edward K. Look
*Assistant Examiner*—Nathan Wiehe
(74) *Attorney, Agent, or Firm*—Birch, Stewart, Kolasch & Birch, LLP

(57) ABSTRACT

An axial flow fan. The axial flow fan includes an impeller, an annular structure, and a plurality of connecting elements. The impeller has a plurality of blades, arranged radially. Each blade has an outer periphery. The outer periphery has a top portion. The annular structure is attached to the top portion of the outer periphery of each blade. Each connecting element respectively connects each blade to the annular structure.

17 Claims, 16 Drawing Sheets

52-1

AXIAL FLOW FAN

This Non-provisional application claims priority under 35 U.S.C. 119(a) on Patent Application No( ) . 93103860 filed in Taiwan on Feb. 18, 2004, the entire contents of which are hereby incorporated by reference.

BACKGROUND OF THE INVENTION

1. Field of the Invention

The present inventions relates to a fan, and in particular, to an axial flow fan with an annular structure.

2. Description of the Related Art

Electronic devices generally produce heat during operation, and thus, a heat-dissipating device or a fan is required to dissipate the excess heat. Since the demand for heat-dissipation has increased, fans must offer optimal performance. A conventional axial flow fan 10*a* is shown in FIG. 1A, having a frame 1 and an impeller 2. FIG. 1B shows a perspective view of the impeller 2. The impeller 2 has a plurality of blades 21 radially arranged. Each blade 21 is, however, long and thin and thus easily deformed and distorted during operation. The quality and performance of the fan is reduced accordingly.

Conventional axial flow fans disclosed in U.S. Pat. No. 5,927,944 and No. 4,287,137 are shown in FIGS. 2 and 3, respectively. In FIG. 2, an axial fan 10*b* has an integral rotating venturi 3, attached at the tip 22 of each blade 21. Although blade strength is enhanced by the integral rotating venturi 3, the integral rotating venturi 3 blocks the entire side inlet, reducing the total performance of the fan.

FIG. 3 is a schematic view of another axial flow fan 10*c*, having a plurality of closed loops 4 and a plurality of parallel straps 41 with clearance between adjacent straps. The closed loops 4 and the straps 41 are disposed on the blades 21, forming a grating. An air inlet 12 is located at a side 11 of the frame 1, air is blocked by the grating straps 41 before exiting from the side 11, producing air turbulence. Furthermore, the difficulty in manufacturing the straps 41 increases the total manufacturing cost of the fan.

Hence, the above method does not satisfy the demands of both structural stability and fan performance.

SUMMARY OF THE INVENTION

Therefore, an object of the present invention is to provide an axial flow fan that eliminates the shortcomings described above.

Another object of the present invention is to provide an axial flow fan with structurally enhanced blades.

Yet another object of the present invention is to provide an axial flow fan that meets safety standards.

The present invention provides an axial flow fan including an impeller, an annular structure, and a plurality of connecting elements. The impeller includes a plurality of radially arranged blades. Each blade has an outer periphery. The outer periphery has a top portion. The annular structure is attached to the top portion of the outer periphery of each blade. Each connecting element is connected to the top portion of the outer periphery of each blade, and each connecting element respectively connects each blade to the annular structure.

Each top portion forms a third of the outer periphery. The thickness of the annular structure is less than or equal to that of the top portion. Each connecting element has a tapered cross section.

In another embodiment, the connecting elements are not tapered.

Each connecting element is substantially perpendicular with the annular structure. Accordingly, the outer peripheries of the blades further include bottom portions, and each connecting element connects the bottom portion and the annular structure.

In one embodiment, the impeller, the annular structure, and the connecting elements are integrally formed.

The annular structure has a circular cross section. Accordingly, the annular structure has an elliptical cross section, a rectangular cross section, or a polygonal cross section.

The axial flow fan further includes a frame. The frame has a notch with the annular structure disposed therein. The notch comprises a sidewall, sloped at an angle, corresponding to the outer periphery of the blade.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

The present invention will become more fully understood from the detailed description given hereinbelow and the accompanying drawings, which are given by way of illustration only, and thus are not limitative of the present invention, and wherein:

FIG. 10A-2 is an enlarged view of the annular structure and the blades of FIG. 10A-1;

DETAILED DESCRIPTION OF THE INVENTION

First Embodiment

Figure 4:
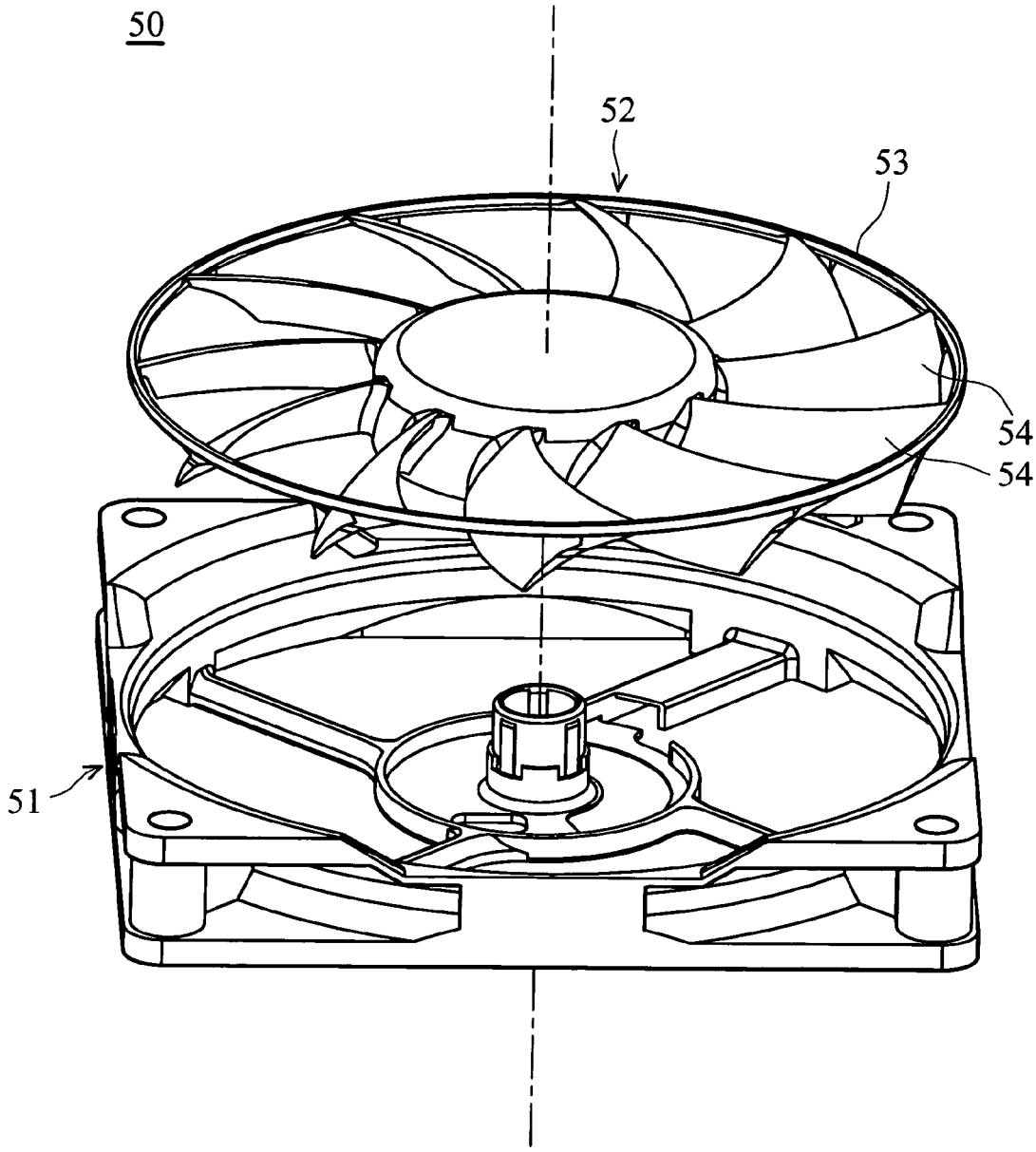
FIG. 4 is an exploded view of an axial flow fan of a first embodiment according to the present invention.
Figure 5A:
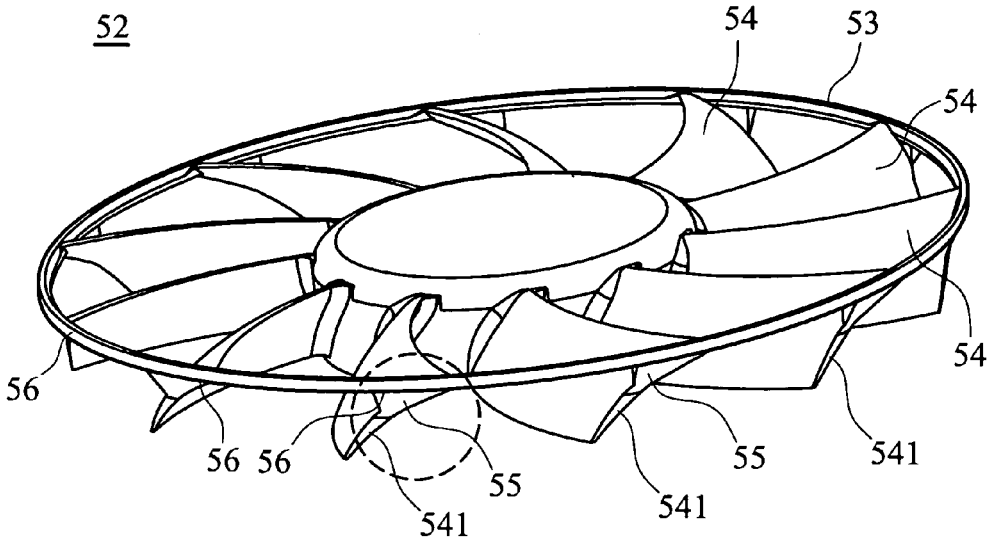
FIG. 5A is a schematic view of an impeller of the axial flow fan of the first embodiment.
Figure 5B:
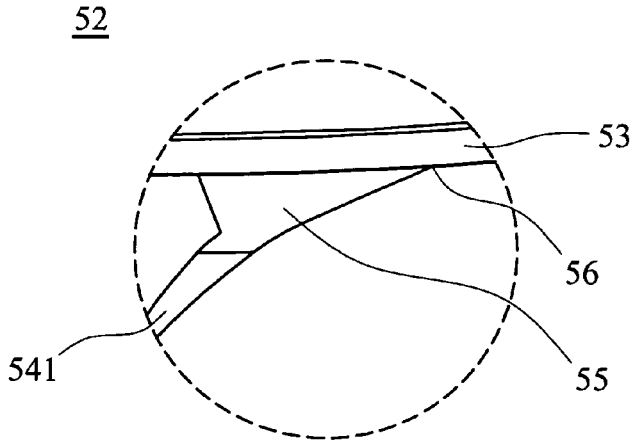
FIG. 5B is an enlarged view of blades and an annular structure of the axial flow fan of the first embodiment.

FIGS. 4, 5A, and 5B are schematic views of an axial flow fan of a first embodiment of the present invention. The axial flow fan 50 includes a frame 51 and an impeller 52. The impeller 52 has a plurality of blades 54, a single annular structure 53, and a plurality of connecting elements 55. The blades 54 are radially arranged, and the annular structure 53 encircles the blades 54.

As shown in FIGS. 5A and 5B, each blade 54 of the impeller 52 has an outer periphery 541, which is the tip of the blade 54. Each outer periphery 541 has a top portion 56 near the air inlet side of the blade 54, which is about one third of the outer periphery 541 (shown by FIG. 12). The thickness of the annular structure 53 is equal to the length of the top portion 56. That is, the annular structure 53 is entirely attached to the top portion 56. Each connecting element 55 is tapered and correspondingly disposed at each blade 54 to connect the annular structure 53 and the top portion 56 of the blade 54. Each tapered connecting element 55 extends from a side of the annular structure 53 toward the outer periphery 541, and connects thereto. The portion of the connecting element 55 near the annular structure 53 has a larger cross section than the portion near the outer periphery 541. That is, the connecting element 55 tapers from the annular structure 53 to the outer periphery 541.

In a variation of the first embodiment (not shown in the figures), the elements common to the first embodiment are omitted. The top portion 56 forms at most a third of the outer periphery 541. Thus, unlike the first embodiment, the thickness of the annular structure 53 may be less than the length of the top portion 56.

Furthermore, the impeller 52, the annular structure 53, and the connecting element 55 are integrally formed into a single unit. As a result, the strength of the impeller 52 is enhanced to prevent deformation and warping.

Figure 6:
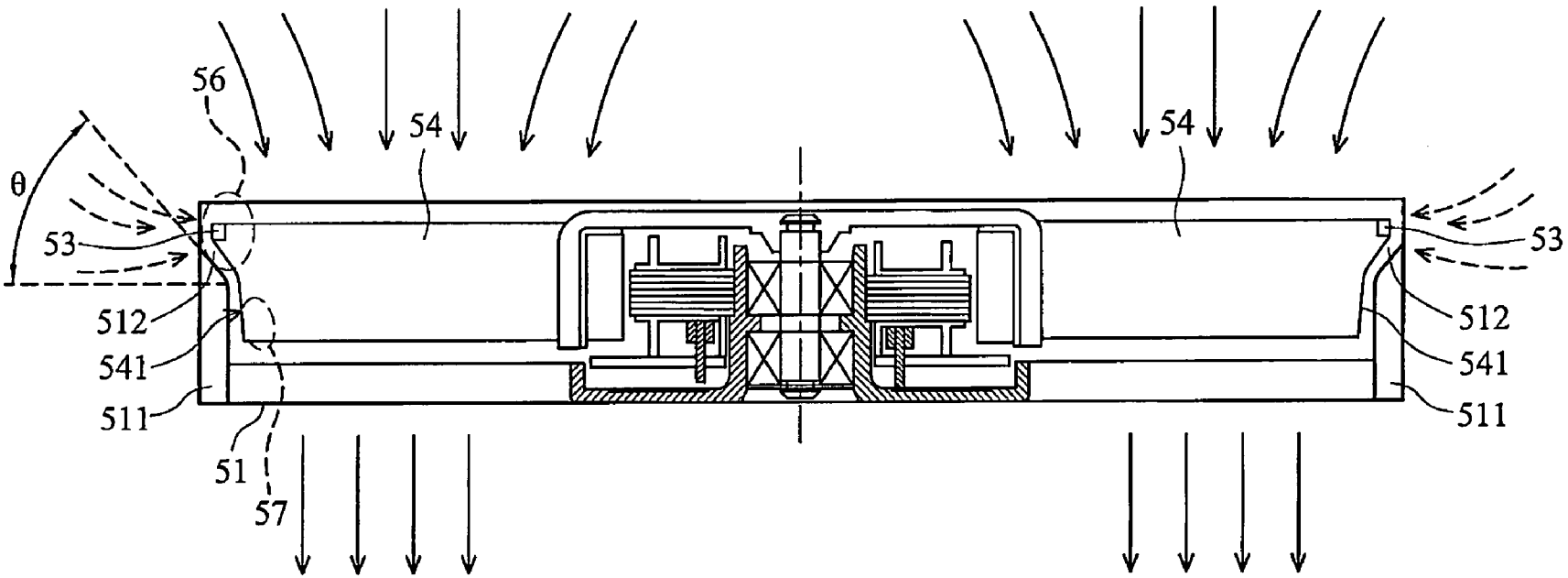
FIG. 6 is a cross-sectional view of the axial flow fan according to the first embodiment.

FIG. 6 is a cross-sectional view of the axial flow fan 50 according to the first embodiment. In order to increase the amount of side airflow and the contact area between the air and the blades 54, the length of each blade 54 is increased. The annular structure 53 compensates for the length of the blades 54 and effectively strengthens the impeller 52 with long blades 54. Additionally, to accommodate the impeller with long blades and preserve the flow path, the shape of the frame 51 must be modified accordingly. It is best to preserve flow path, and thus, the frame must be modified. The frame 51 of the present invention has a notch 512 formed thereon. The blades 54 may extend to the notch 512. The shapes of the blades 54 and the annular structure 53 are designed corresponding to the notch 512 such that the annular structure 53 is partially disposed therein. Specifically, the notch 512 comprises a sidewall 511, sloped at an angle θ with respect to the horizon. The angle θ varies with the shape of the outer periphery 541 of the blade 54. Due to the design of the notch 512, when the annular structure 53 is attached to the blades 54, the connection point may be varied. In the first embodiment, the annular structure 53 is disposed at the exterior side of the outer periphery 541, near the notch 512, as shown in FIG. 6. The annular structure 53 protrudes toward the notch 512. Thus, the present invention can enhance the strength of the extended blades 54.

Additionally, the present invention also increases the amount of air inflow. The direction of air may follow the arrows as shown in FIG. 6 to enter the impeller. The airflow shown by the direction of solid arrows is referred to as front airflow. The air may also enter the impeller from both sides according to the dashed arrows. The airflow entering from the side is referred to as side airflow. Thus, the air may contact the outer periphery 541 of the blades 54 from both front and side directions. Thus, the present invention not only enhances the strength of the elongated blades 54, but also increases the total contact area between the outer periphery 541 and the air. As the contact area increases, the amount of the side inflow increases. The combination of the front and side airflows increases the total outflow of air accordingly. Furthermore, due to the design of the frame 51, the profile and size of the axial fan assembly remains unchanged, yet successfully increases the effective contact area between air and the blades 54. Since the structural strength of the blades 54 is enhanced, the life of the fan assembly is also increased accordingly without blocking the side inflow, thus improving overall performance.

Figure 7A:
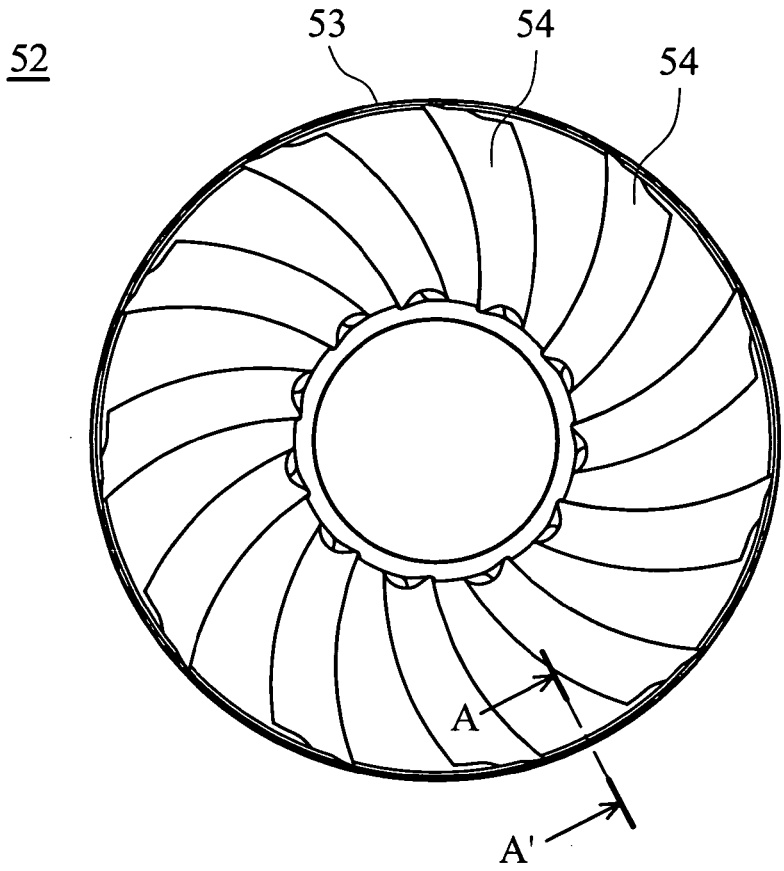
FIG. 7A is a top view of the impeller of the first embodiment.
Figure 7B:
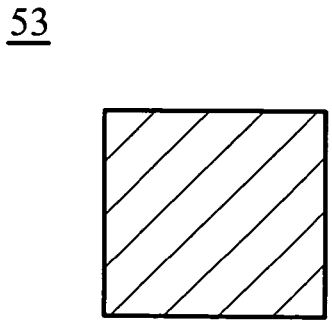
FIG. 7B is a cross-sectional view along line AA' of FIG. 7A for observing the annular structure of the first embodiment.

In addition, as shown in FIGS. 7A and 7B, the annular structure 53 viewed from line AA' has a rectangular cross section, increasing the structural strength thereof, and the rectangular shape of the cross section is designed to accommodate the airflow path. Thus, the performance of the fan is greatly improved.

Second Embodiment

Figure 8A:
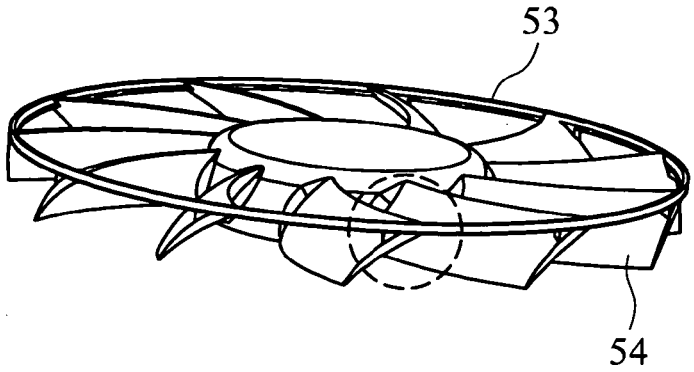
FIG. 8A is a schematic view of an impeller of the axial flow fan of a second embodiment.
Figure 8B:
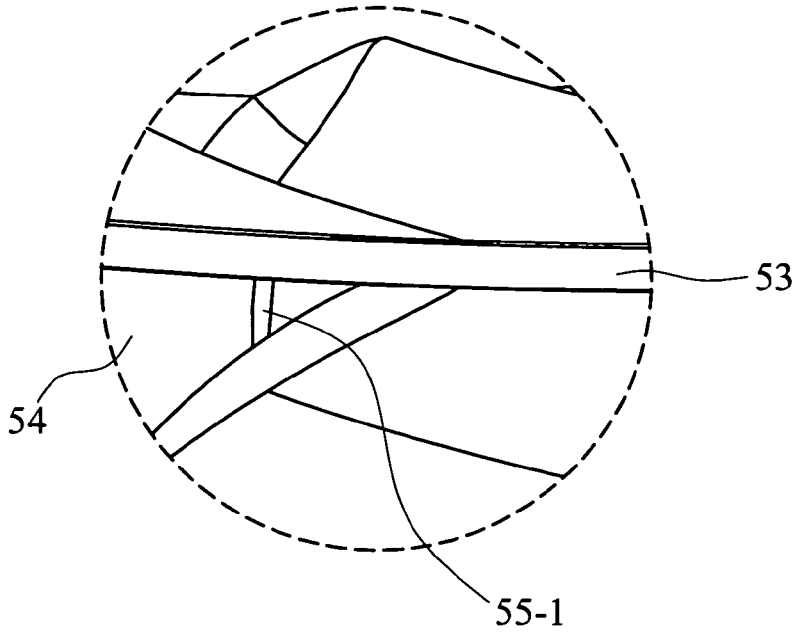
FIG. 8B is an enlarged view of the blades and an annular structure of the axial flow fan of the second embodiment.

FIGS. 8A and 8B are schematic diagrams of an impeller 52-1 of an axial flow fan of the second embodiment, from which elements common to the first embodiment are omitted. In this embodiment, the connecting elements 55-1 connect the annular structure 53 and a portion of the blades 54. The difference is that each connecting element 55-1 connects the annular structure 53 and the blade 54 at roughly the central point thereof. The connecting elements 55-1 are not tapered and are substantially perpendicular with the annular structure 53. Consequently, the annular structure 53 and each connecting element 55-1 form a T-shaped structure.

Third Embodiment

Figure 9A:
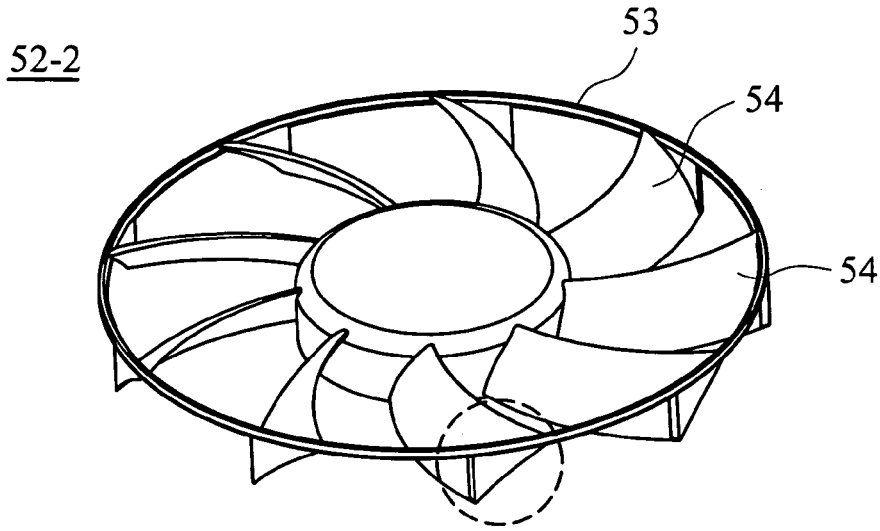
FIG. 9A is a schematic view of an impeller of the axial flow fan of a third embodiment.
Figure 9B:
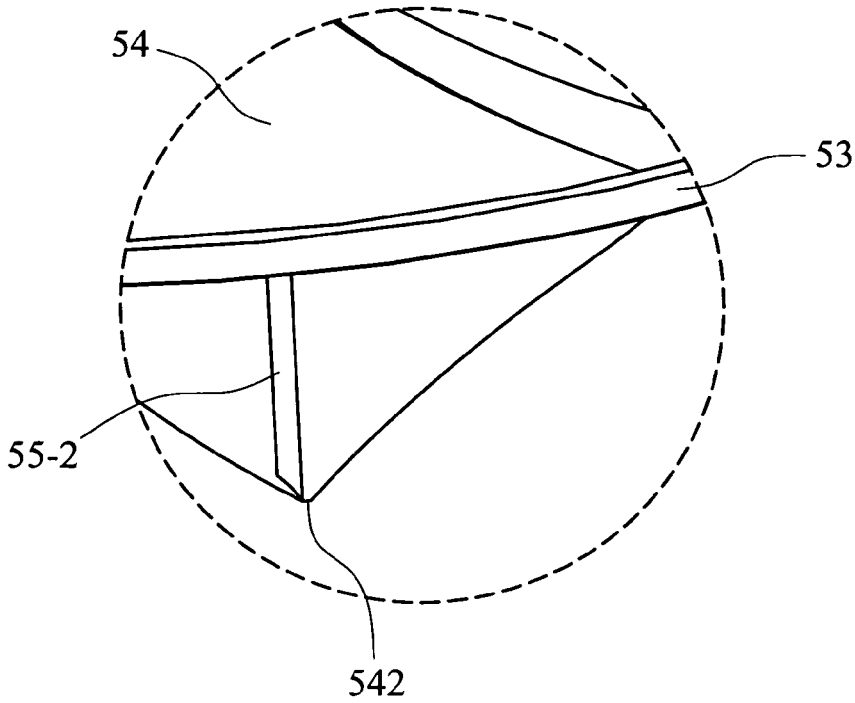
FIG. 9B is an enlarged view of the blades and an annular structure of the axial flow fan of the third embodiment.
Figure 12:
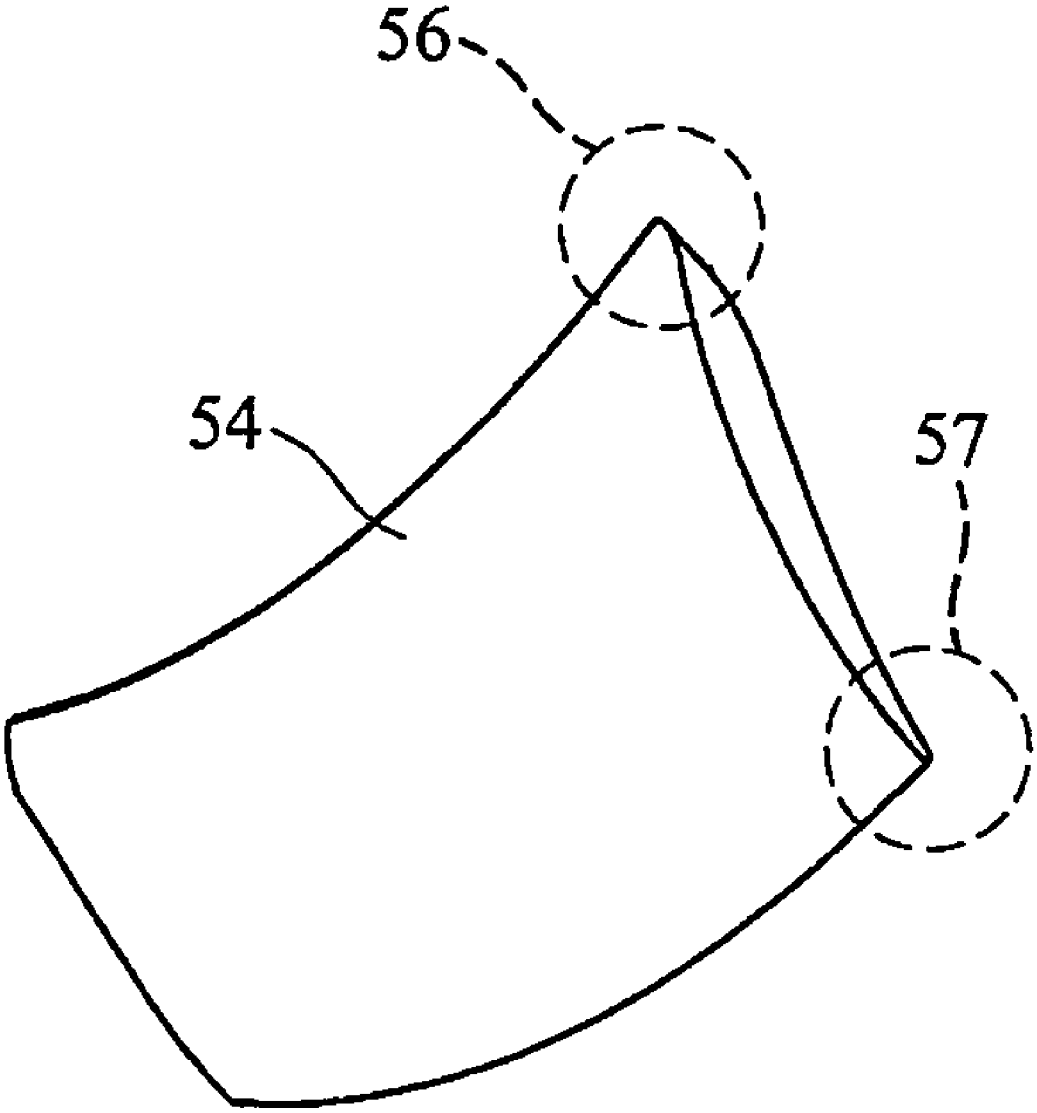
FIG. 12 is a schematic view of one of the blades.

FIGS. 9A and 9B are schematic diagrams of an impeller 52-2 of an axial flow fan of the third embodiment, from which elements common to the first embodiment are omitted. In this embodiment, the connecting elements 55-2 connect the annular structure 53 and the blades 54. The difference is that each connecting portion 55-2 connects the annular structure 53 and the blades 54 at the bottom end 542. The bottom end 542 is the end of a bottom portion 57 which is near the air outlet side of the blade 54 (as shown in FIG. 12). The bottom portion 57 is about one third of the outer periphery. The connecting elements 55-2 are not tapered and are substantially perpendicular with the annular structure 53. Consequently, the annular structure 53 and each connecting element 55-2 roughly form a T-shaped structure.

Figure 1A:
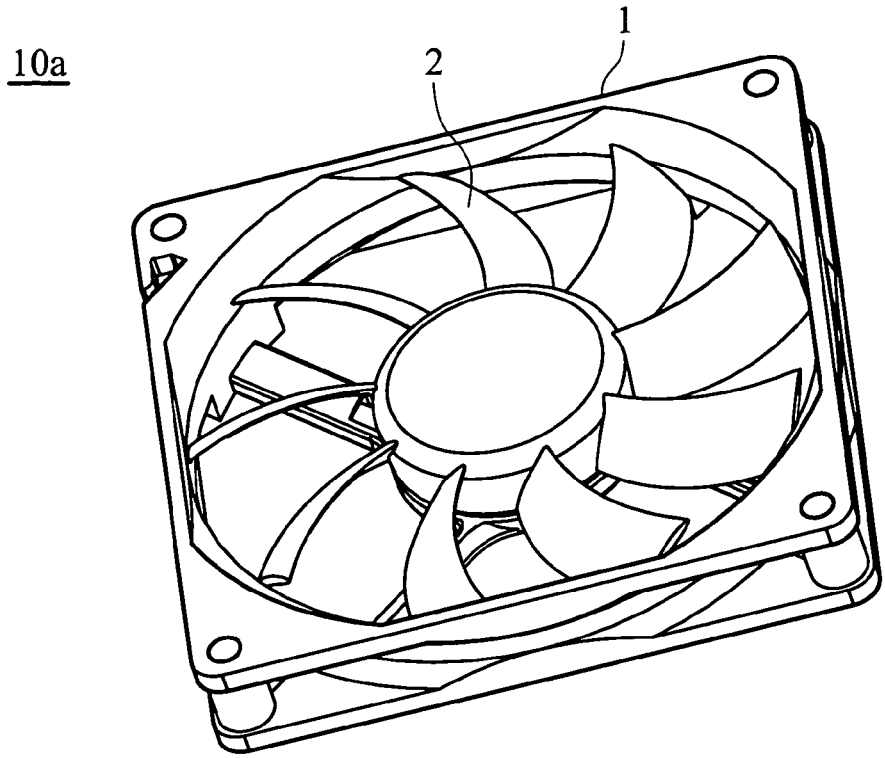
FIG. 1A (RELATED ART)
FIG. 1A is a schematic diagram of a conventional axial flow fan.
Figure 1B:
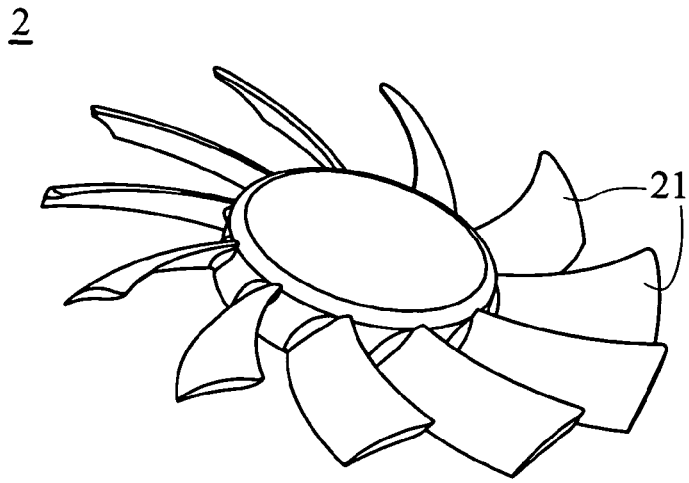
FIG. 1B (RELATED ART)
FIG. 1B is a schematic diagram of an impeller of the conventional axial flow fan.
Figure 2:
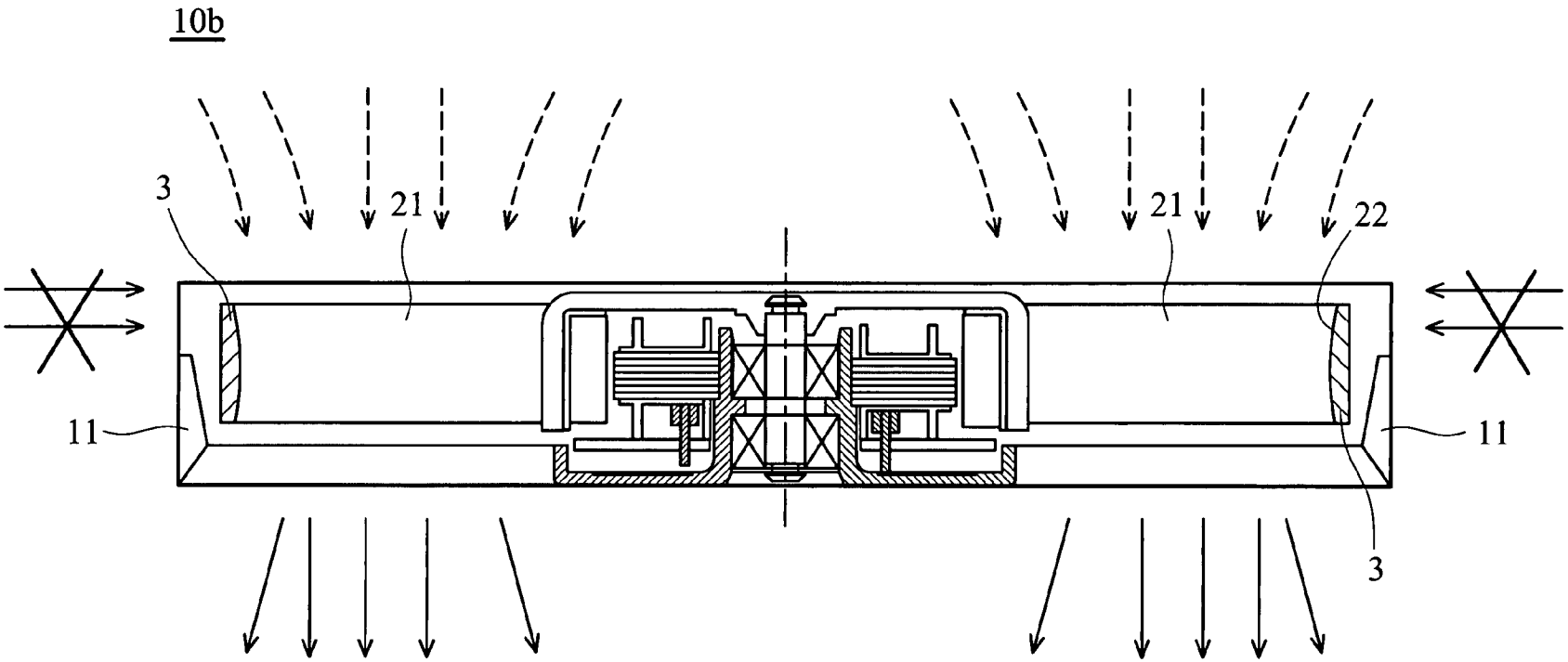
FIG. 2 (RELATED ART)
FIG. 2 is a cross-sectional view of another conventional axial flow fan according to U.S. Pat. No. 5,927,944.
Figure 3:
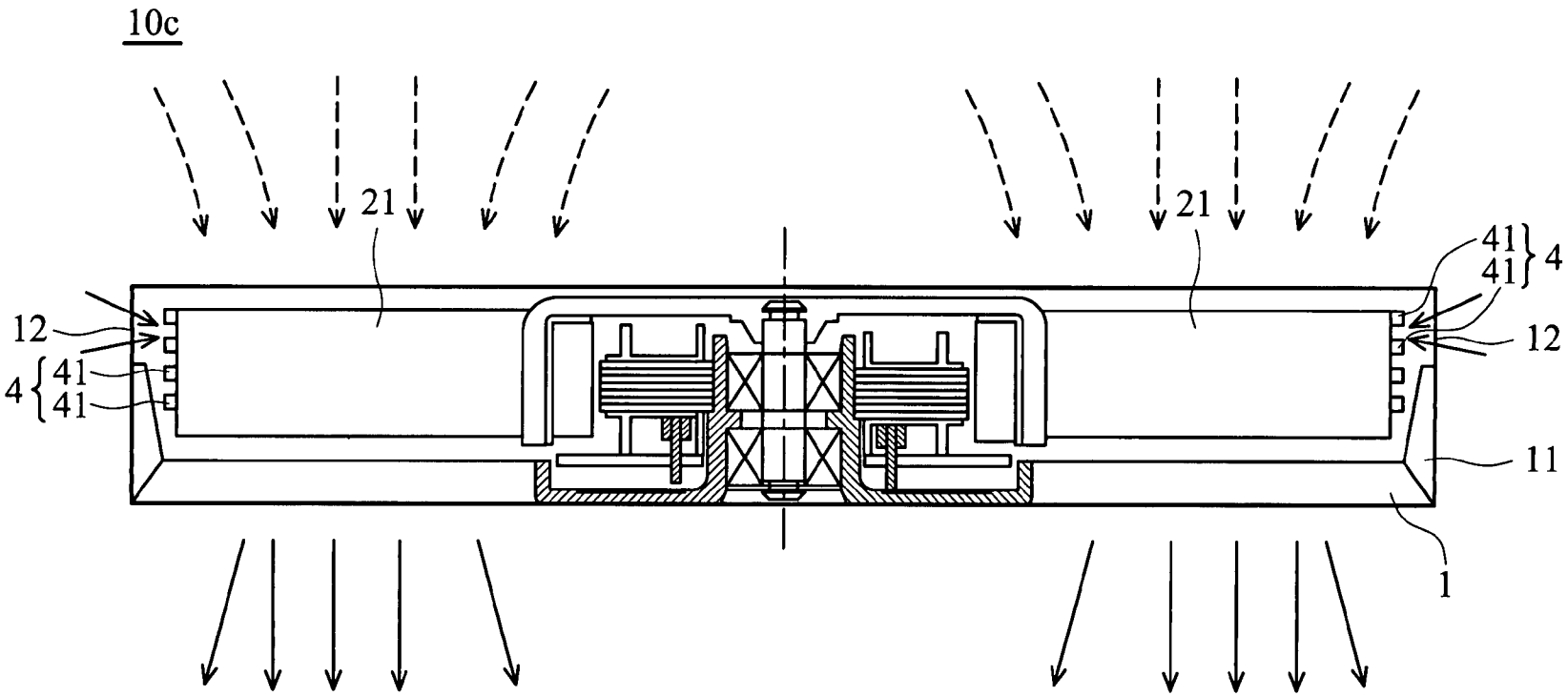
FIG. 3 (RELATED ART)
FIG. 3 is a cross-sectional view of another conventional axial flow fan according to U.S. Pat. No. 4,287,137.
Figures 1, 10A:
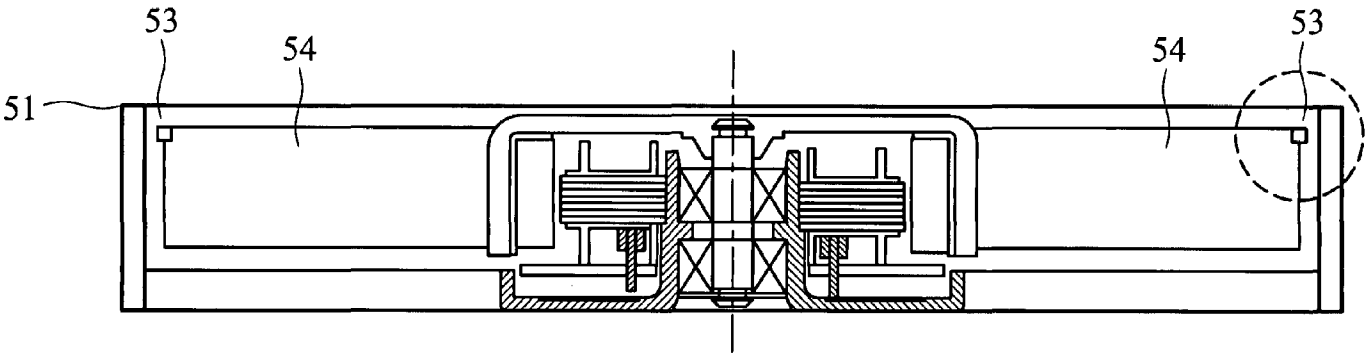
FIG. 10A-1 is a cross-sectional view of a variation of the axial flow fan according to the present invention.
Figures 2, 10A:
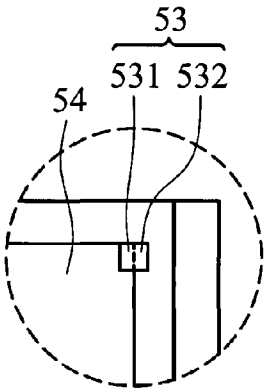

The frame and impeller of the described embodiments can be varied according to different flow path combinations, as long as constant pressure and airflow concentration are maintained. In one variation, as shown in FIG. 10A-1, the frame 51 does not have a notch, and the annular structure 53 of the impeller has a portion 531 disposed on the outer periphery 541 of the blade 54, and the other portion 532 protrudes from the blade 54, as shown in the enlarged view of FIGS. 10A-2. The annular structure 53 partly protrudes and is disposed in the frame 51.

Figure 10B:
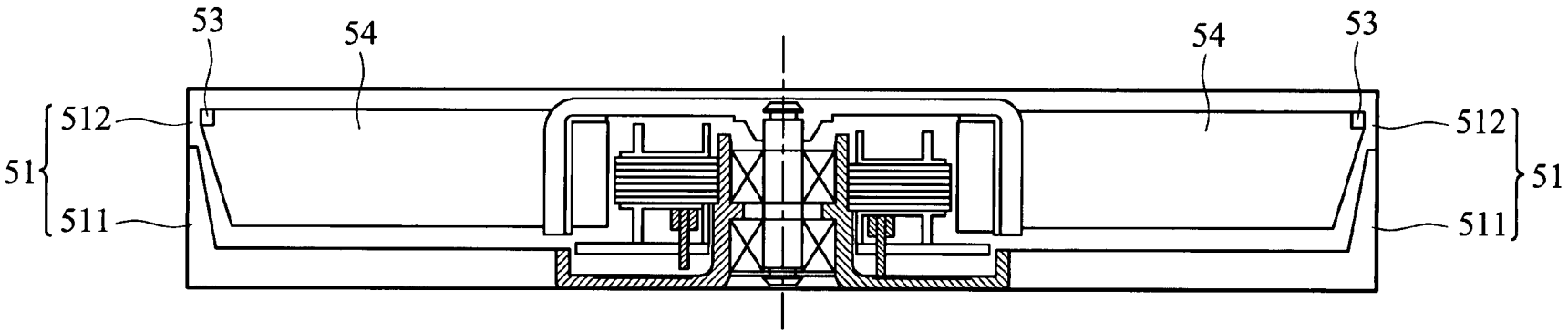
FIG. 10B is a cross-sectional view of another variation of the axial flow fan according to the present invention.

In other variations of the above embodiments, the impeller is designed to be accommodated by the frame 51. The length and shape of the impeller varies with the flow path without blocking the side inflow. Since the profile of the frame 51 is preserved, the pressure and airflow concentration are unaffected. As shown in FIG. 10B, a sidewall 511 of the frame 51 has a notch 512 formed thereon. The sidewall 511 is sloped according to the shape of the blade. The annular structure 53 of the impeller is entirely disposed at the outer periphery 541 of the blade 54.

Figure 10C:
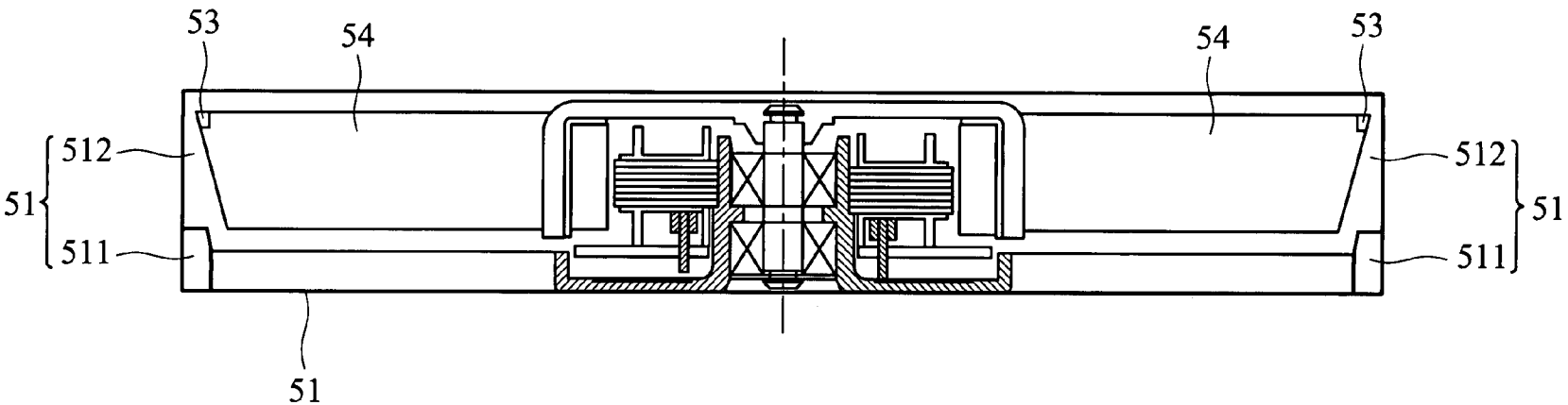
FIG. 10C is a cross-sectional view of the other variation of the axial flow fan according to the present invention.
Figure 11A:
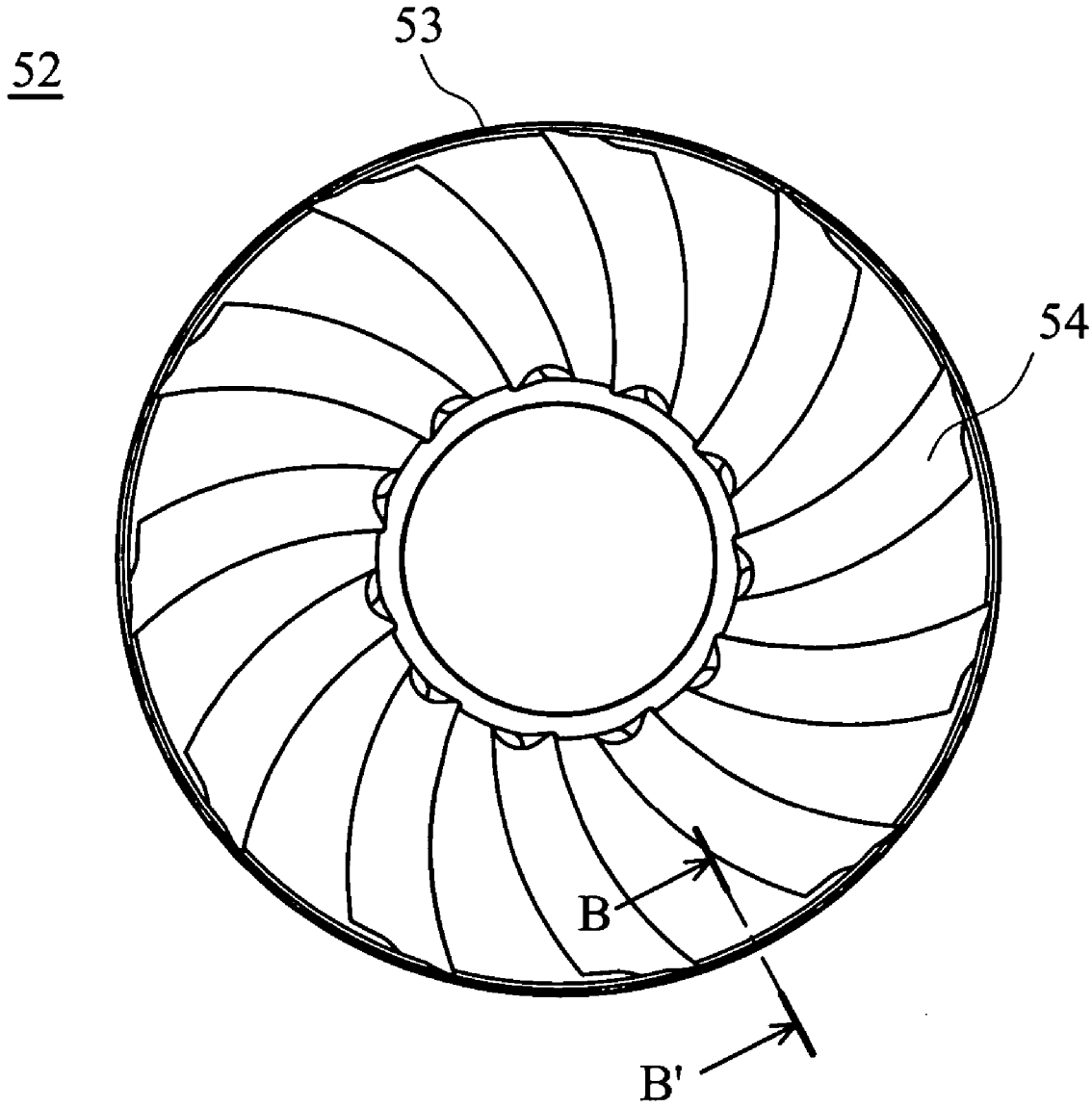
FIG. 11A is a top view of the impeller of the present invention.
Figure 11C:
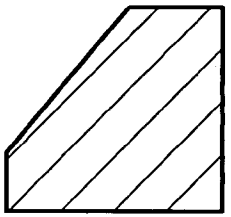
FIG. 11C is a cross-sectional view along line BB' of FIG. 11A of a rectangular annular structure with a notch according to the present invention.
Figure 11E:
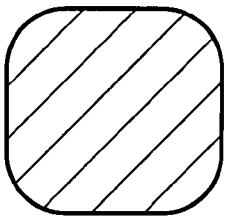
FIG. 11E is a cross-sectional view along line BB' of FIG. 11A of a polygonal annular structure with rounded edges according to the present invention.
Figure 11B:
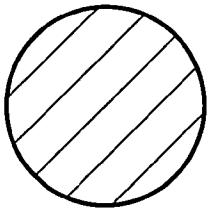
FIG. 11B is a cross-sectional view along line BB' of FIG. 11A of a circular annular structure according to the present invention.
Figure 11D:
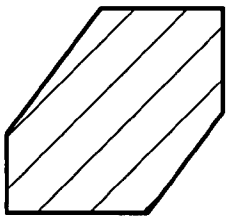
FIG. 11D is a cross-sectional view along line BB' of FIG. 11A of a polygonal annular structure according to the present invention.
Figure 11F:
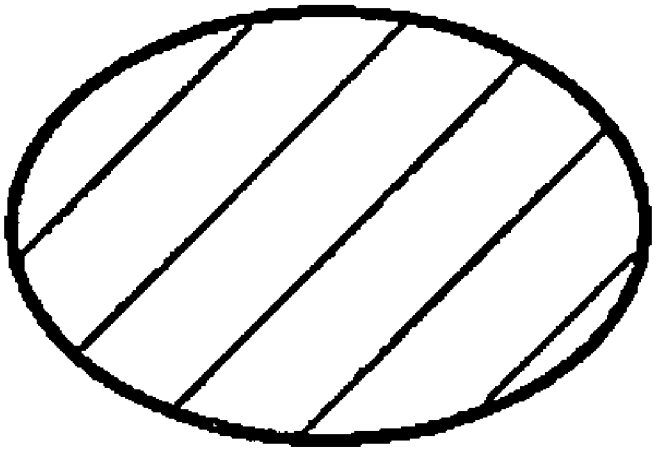
FIG. 11F is a cross-sectional view along line BB' of FIG. 11A of an elliptical annular structure according to the present invention.

In another variation, as shown in FIG. 10C, the notch 512 of the frame 51 is enlarged, and the sidewall 511 is shortened. Thus, the contact area between the blades 54 and the outer periphery 541 is enlarged. As a result, the contact area is maximized in this varied embodiment, increasing both side and front airflow.

The cross section of the annular structure 53 of the impeller 52 changes with frame with different flow paths. Thus, other than the rectangular cross section in the first embodiment, the cross section can be circular, elliptical, rectangular with a notch, polygonal, or round rectangular, as shown in FIGS. 11A to 11F.

Thus, the present invention provides a single annular structure to connect each blade thereto by a connecting element. The structure of the impeller is enhanced. Particularly, when the fan utilizes a bear frame, the design of annular structure additionally provides enhanced safety, preventing injury or damage by the impeller during operation, and further avoiding breakage of PVC wires. Hence, the performance of the axial flow fan is optimized for various flow paths and the amount of the side inflow of the fan is also maximized.

While the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. An axial flow fan, comprising:

an impeller, comprising a plurality of blades arranged radially, wherein each of the blades comprises an outer periphery;

an annular structure, directly connected to the outer peripheries of the blades; and a plurality of connecting elements, each connecting of the outer periphery of each blade and the annular structure.

2. The axial flow fan as claimed in claim 1, wherein each blade has a top portion near an air inlet side thereof with a thickness equal to one-third thickness of the outer periphery, and each connecting element is connected to the top portion.

3. The axial flow fan as claimed in claim 2, wherein the thickness of the annular structure is less than or equal to that of the top portion.

4. The axial flow fan as claimed in claim 1, wherein each connecting element is tapered.

5. The axial flow fan as claimed in claim 1, wherein each connecting element is not tapered.

6. The axial flow fan as claimed in claim 1, wherein each connecting element is substantially perpendicular to the annular structure.

7. The axial flow fan as claimed in claim 1, wherein each blade has a bottom portion near an air oulet side thereof with a thickness equal to one-third thickness of the outer periphery, and each connecting element is connected to the bottom portion.

8. The axial flow fan as claimed in claim 1, wherein the impeller, the annular structure, and the connecting elements are integrally formed.

9. The axial flow fan as claimed in claim 1, wherein the annular structure has a circular cross section.

10. The axial flow fan as claimed in claim 1, wherein the annular structure has an elliptical cross section.

11. The axial flow fan as claimed in claim 1, wherein the annular structure has a rectangular cross section.

12. The axial flow fan as claimed in claim 1, wherein the annular structure has a polygonal cross section.

13. The axial flow fan as claimed in claim 1, further comprising a frame with a notch for allowing the annular structure to be partially disposed therein.

14. The axial flow fan as claimed in claim 13, wherein the notch comprises a sidewall sloped at an angle, corresponding to the outer periphery of the blades.

15. The axial flow fan as claimed in claim 1, wherein each connecting element connects a central portion of the outer periphery of each blade and the annular structure.

16. The axial flow fan as claimed in claim 1, further comprising a frame having an inner surface parallel to the outer periphery of the blade.

17. The axial flow fan as claimed in claim 1, wherein the outer periphery of the blade has a sloped profile.

* * * * *